United States Patent [19]

Grabher

[11] Patent Number: 4,744,484

[45] Date of Patent: May 17, 1988

[54] CAN, AND A DIAPHRAGM FOR THE CLOSING AND SEALING THEREOF

[75] Inventor: Werner Grabher, Au, Switzerland

[73] Assignee: Grabher Indosa-Maschinenbau AG, Switzerland

[21] Appl. No.: 883,306

[22] Filed: Jul. 8, 1986

[30] Foreign Application Priority Data

Jul. 10, 1985 [CH] Switzerland ..... 2995/85

[51] Int. Cl.[4] ..... B65D 53/00

[52] U.S. Cl. ..... 220/276; 220/270; 215/253

[58] Field of Search ..... 220/276, 269, 281, 266, 220/270, 258, 89 A; 215/250, 253, 255, 256

[56] References Cited

U.S. PATENT DOCUMENTS

| | | | |
|---|---|---|---|
| 3,746,202 | 7/1973 | Moller | 215/253 |
| 3,859,942 | 1/1975 | Molier | 113/121 A |
| 4,212,409 | 7/1980 | Jeppsson | 220/270 X |
| 4,333,585 | 6/1982 | Del Bon | 220/276 X |

FOREIGN PATENT DOCUMENTS

| | | |
|---|---|---|
| 0007487 | 7/1979 | European Pat. Off. . |
| 3212990 | 11/1982 | Fed. Rep. of Germany . |
| 2118077 | 7/1972 | France . |
| 639342 | 11/1983 | Switzerland . |
| 1473828 | 3/1980 | United Kingdom . |
| 2052432 | 6/1983 | United Kingdom . |

*Primary Examiner*—Steven M. Pollard

*Attorney, Agent, or Firm*—Cushman, Darby & Cushman

[57] ABSTRACT

Can-like containers are frequently closed or sealed with a diaphragm, the wall of which is provided with severance points, or the part of which that is U-shaped in cross-section (3) covering the cut edge (16) of the can wall (17) is already located at least partially at a distance (a) from the nearly dish-shaped closure part (14). The diaphragm (14) according to the present invention has severance points that are formed by narrow ligaments (4) interrupted by cut-outs (5), said ligaments being arranged alternatingly along a circumferential line in the rim (2) of the diaphragm. A diaphragm for the closing of can-like containers is e.g. fabricated in that the foil is deep-drawn, and in the end phase of the closing movement cut-outs (5) are formed in its rim (2) by shearing edges (8 and 11). At least one shearing edge (8) is interrupted by notches (9), in the area of which ligaments (4) remain.

7 Claims, 4 Drawing Sheets

Figure 2:
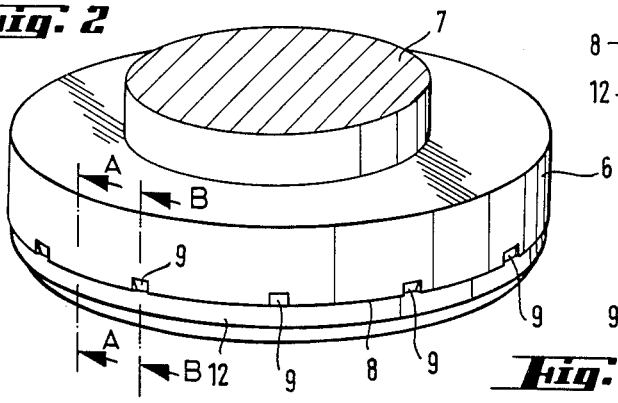

Fig. 8
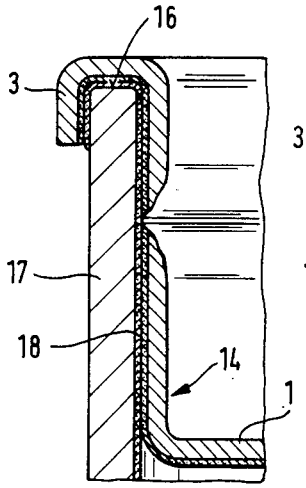
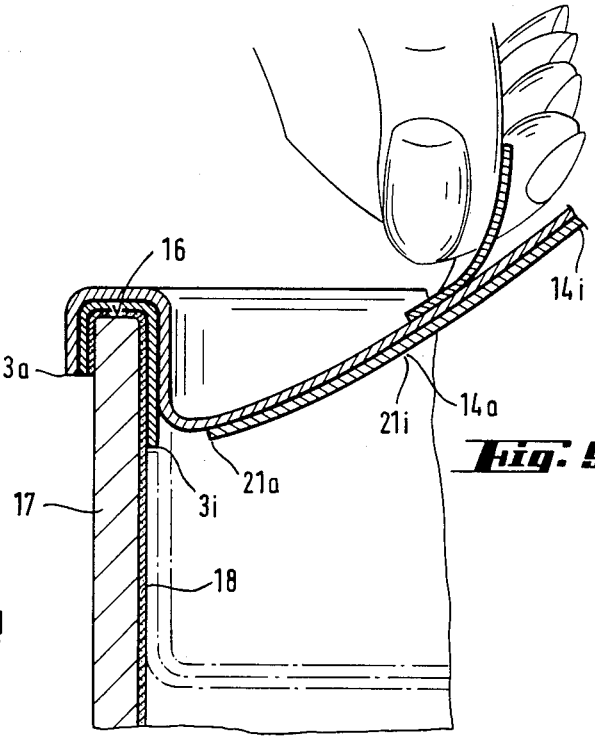
Fig. 9
Fig. 10a
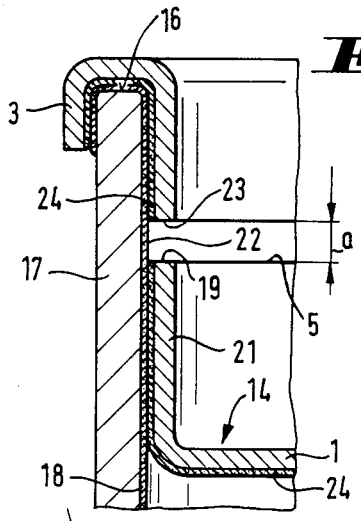
Fig. 10b
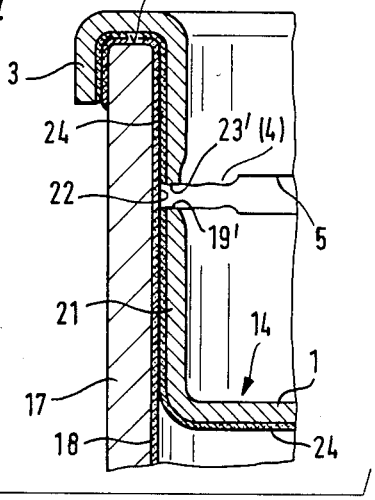
Fig. 10

CAN, AND A DIAPHRAGM FOR THE CLOSING AND SEALING THEREOF

BACKGROUND OF THE INVENTION

The invention relates to a can; to a process for manufacturing the can; to a diaphragm for the closing and sealing thereof; and finally to a device for the manufacture of the diaphragm.

The prior art can is described in EU-A 007 487, but in practice it has never become known because on the one had the process described for the manufacture thereof required too great an effort, and on the other hand it did not function at all. Namely, in the aforementioned letters patent it was proposed that the collar part of the closing diaphragm to first be reduced in thickness or perforated by means of hard pressing surfaces along a circumferential line to serve later as a severance point, then to insert the diaphragm in the can opening, to heat it and to separate the diaphragm collar and the edge covering by the application of a pressure acting radially to the outside, along or next to the severance line. Apart from this process, which is complicated and susceptible to trouble, in practice a really complete separation of the two diaphragm parts has never been achieved, so that when the can was opened by tearing open the diaphragm dish, parts of the covering part were always pulled out along with the dish and frayed. Hence, precisely the effect occurred that the invention intended to avoid.

Another proposal is described in DE-A 32 12 990, but it could also not be realized in practice. There, the diaphragm consists of two layers; only the inner layer of the diaphragm dish rim is separated from the attendant edge covering, while the outer layer enwraps the dish and the edge covering without injury and serves for tearing open. It is as good as impossible to match the adhesive strength of the inner layer on the inside of the can to that of the two foils such that the effect that is endeavored by the invention is achieved—this due to contradictory requirements: in the dish area the adherence of the two foils on top of one another must be greater than the adherence of the collar of the inner layer on the inside of the can; in the coverage area it would have to be exactly the opposite in order that the inside foil covers the cut edge of the wall of the can with surety even after the tearing open.

The invention therefore has as its objective to devise a can of the type mentioned above that avoids the aforementioned disadvantages and that can be realized in practice. A can design in such a manner can be manufactured easily and poses no tearing-open problems, but rather leaves a smooth and clean covered part.

In accord with a further objective of the invention a process is to be devised with which the can can be closed and sealed in as simple a manner as possible, preferably in a single production operation, while achieving the endeavored advantages.

It is moreover the objective of the present invention to devise a diaphragm for closing and sealing cans or similar containers that can be made in a single operation, and that still provide easy opening by means of suitable severance points. This objective is achieved by the present invention by means of cut-outs and ligaments being provided alternatingly in the wall along a circumferential lines.

Finally, it is the objective of the present invention to devise a process and a device for the rational manufacture of the diaphragm according to said invention that is used for making a can that is closed and sealed according to the present invention.

A ligament in the diaphragm according to the present invention has a length of about 1 to about 30%, preferably 3 to 20%, especially 5 to 15% of the cut-out, preferably 6 to about 12, especially 8 to 10 cut-outs and ligaments being provided, depending on the diameter of the diaphragm. Fewer (longer) cut-outs and/or shorter ligaments endanger the workability of the diaphragm when it is being glued into the can because the long cut-outs tend to pull apart. More (shorter) cut-outs and/or longer ligaments incur greater problems on tearing open. The correct selection can easily be made by any person skilled in the art in function especially of the diaphragm material thickness and stiffness, as well as of the tolerances of the can.

In order that the diaphragm can be sealed in the can dependably it is expedient for the severance line to extend above half height of the wall, e.g. in the upper third thereof. To facilitate the tearing of the ligaments during the sealing they are preferably already pre-bent and/or even reduced in thickness—at least over a part of their width—so that they form severance points that actually tear on the application of a pull, while retaining the sealing of the edge covering. It is especially expedient for the ligaments to have a nearly fusiform cross-section by their two ends at the ends bordering on the respective cut-outs being crushed or slit to zero thickness.

In order to be able to manufacture such a diaphragm with an integral severance point in such a simple manner, according to a further embodiment of the invention a deep-drawing die and a matrix are used, each having a shearing edge all round for making the cut-outs. At least the shearing edge of one part of the tool is interrupted on the circumference, preferably at uniformly distributed locations.

Figure 1:
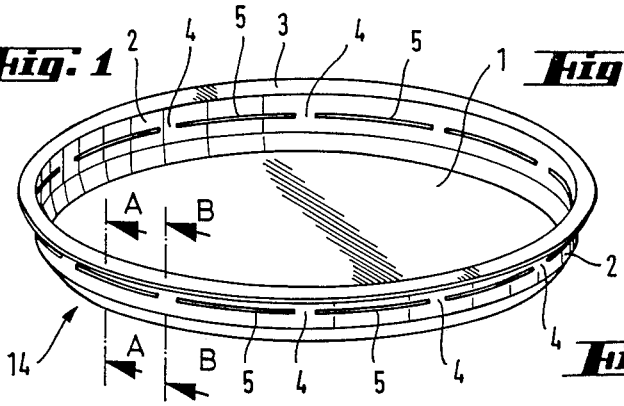

On the basis of an embodiment the invention is described in detail. Shown are:

FIG. 1 a finished diaphragm

FIG. 2 the deep-drawing die

Figure 3:
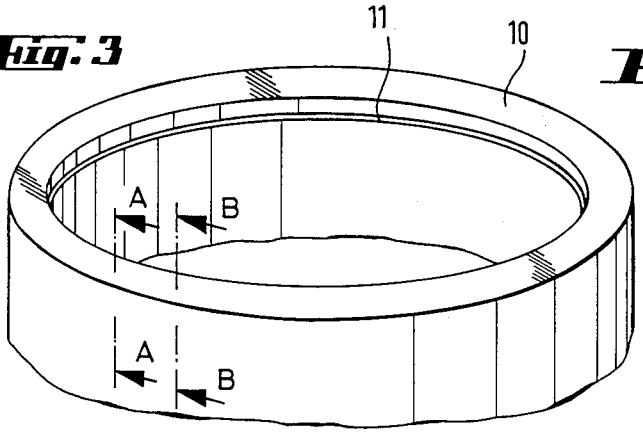

FIG. 3 the attendant matrix

Figure 4:
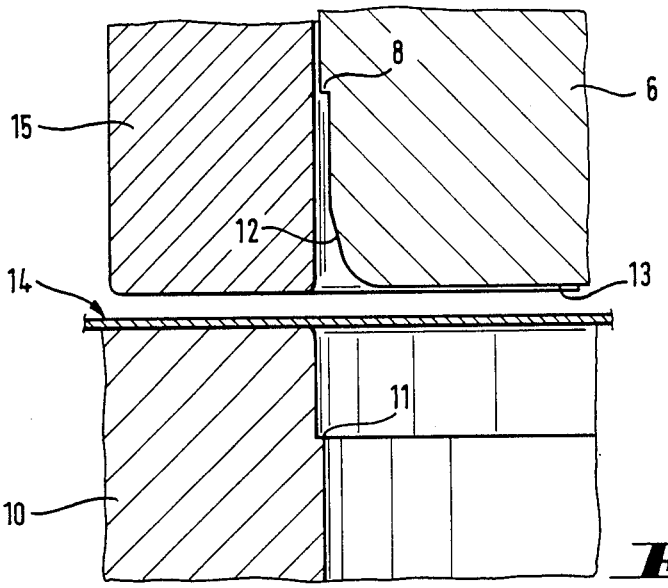

FIG. 4 the tool in the open position in the cut-out area

Figure 5:
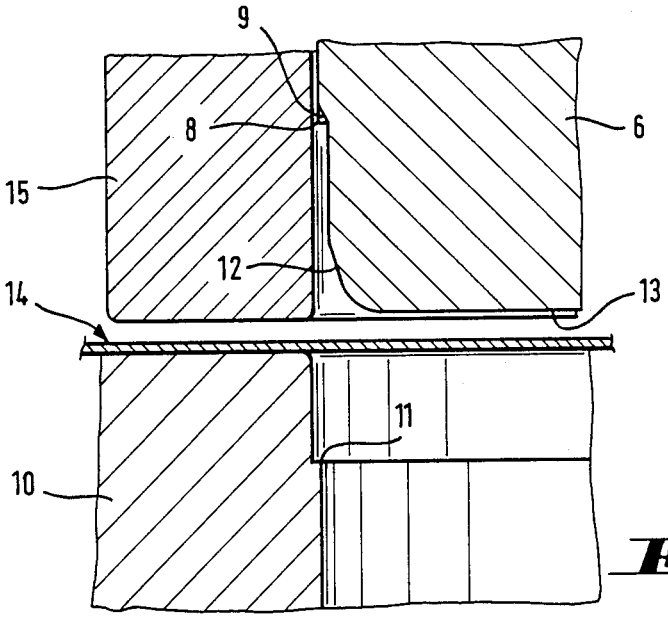

FIG. 5 the tool in the open position in the ligament area

Figure 6:
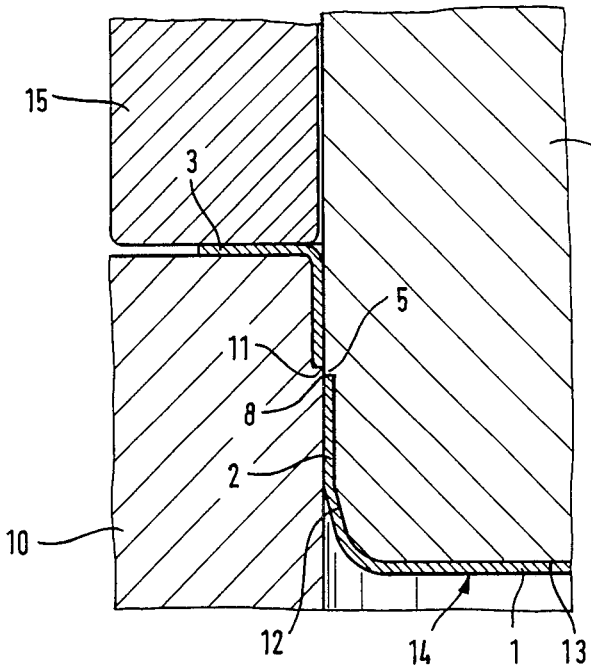

FIG. 6 the tool in the closed position in the cut-out area

Figure 7:
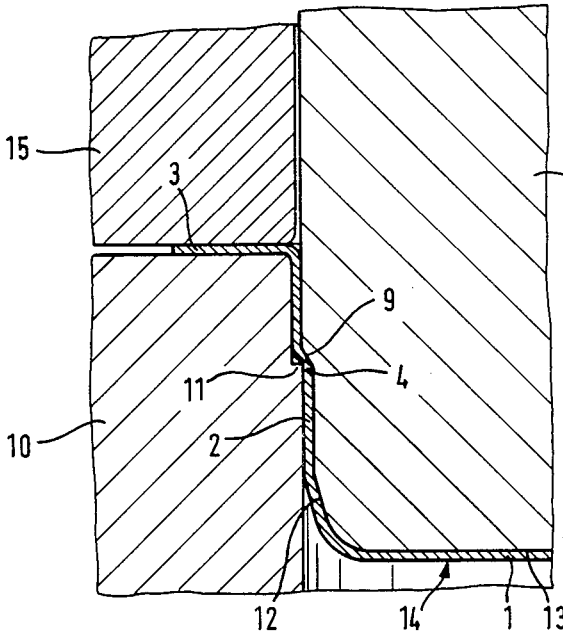

FIG. 7 the tool in the closed position in the ligament area

FIGS. 8 and 9 a cross sectional elevation of the end of a can wall closed with a membrane in the conventional manner; and FIG. 10 a cross-section through the end of a wall of a can according to the present invention in the area of a cut-out (10*a*) and of a ligament (10*b*).

Figure 1A:
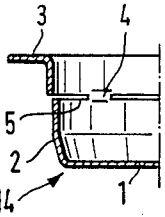
Figure 1B:
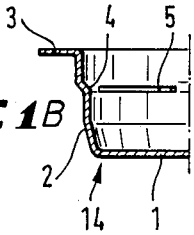

FIG. 1 shows a perspective view of a finished (circular) diaphragm 14 (for a can with a round cross section). The diaphragm consists of dish 1, the rim 2, as well as the radially projecting flange 3. The elongate slots 5 are distributed uniformly on the circumference and limited by the ligaments 4 are arranged in the upper third of the wall 2. Sections A and B, shown in a figure, are also indicated (FIG. 1A, FIG. 1B). The arrangement of the elongate slots 5 and the ligaments 4 are shown. The diaphragm material can be of a thickness of e.g. 40 to 60 microns.

Figure 2A:
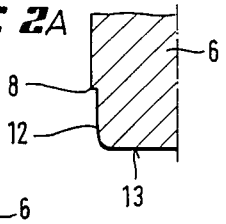
Figure 2B:
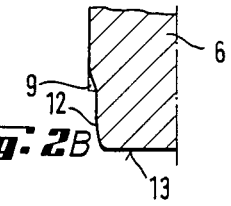

From FIG. 2 the deep drawing die 6, as well as its areas A and B, are shown. At the top the deep drawing die 6 has a shaft 7 for clamping in the tool. The die itself is a disk-like part of the tool with a drawing radius 12 on the circumference of the face 13; the cylindrical drawing edge ends in a shearing edge 8, which is arranged in the areas A and is shown in the associated cross-sectional view (FIG. 2A). The notch 9 is arranged in the areas B. Here, only the shearing edge 8 is interrupted, namely with a depth of about 100 microns and an inclination of 25° to 60° seen from the longitudinal axis. The width of the notch 9 corresponds to the desired width of a ligament 4.

Figure 3A:
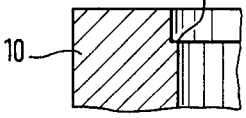
Figure 3B:
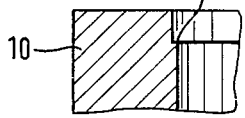

FIG. 3 shows the matrix 10. This matrix is an annular tool with a shearing edge 11 on its inside that can be provided with interruptions, which however are not shown in FIG. 3. This can also be recognized by virtue of the fact that the cross-sections A and B (FIG. 3A, FIG. 3B) are identical.

FIGS. 4 and 5 show the tool in the open position. The diaphragm foil 14, which is prepared in the form of a flat disk, is on top of the matrix 10. The holddown device 15 guided by the die 6 is in the form of a ring. Here too the drawing contour 12 can be recognized, the shearing edge 8 being shown in FIG. 4, whereas the notch 9 in FIG. 5 represents the interruption of the same.

FIGS. 6 and 7 show the tool in the closed position. On lifting the matrix first hits the holddown 15 and immediately thereafter enclasps the deep drawing die 6. The diaphragm foil 14 is now converted into the dish 1, the rim 2 and the flange 3. FIG. 6 shows that the finished diaphragm is cut open on the side. This corresponds to point A in FIG. 1. This is different in FIG. 7, where the cut was interrupted by notch 9, thereby producing only a crimping in the wall 2 of the diaphragm foil 14.

The manufacture is effected in the manner that when the tool is closed first dish 1, rim 2 and flange 3 are shaped, while at the same time the rim 2 experiences a Z-shaped configuration in cross-section, and in the end phase of the closing movement the elongate slots 5 are cut by shearing edges 8 and 11.

In manufacturing a container using the diaphragm of the present invention, the diaphragm as manufactured in placed on the can wall 17 and held in position with the aid of die means while the dish of the diaphragm is forced a distance into the can until the ligaments 4 are torn.

Essential is that the shearing edges 8 and 11 have an only slight overlap, namely in the order of 100 to 200 microns, which assures that the diaphragm can be fabricated in a single production operation, the elongate slots 5 being cut and the ligaments 4 crimped or bent and eventually even—at least partially—reduced in cross-section, thereby forming the desired severance points.

To be regarded as especially important however is the fact that only a single operation suffices to fabricate this diaphragm, and that the use of further machines is not required. Existing tools can eventually be converted by the fitting of shearing edges 8 and notches 9.

As mentioned above, a can closed in the conventional manner according to FIG. 8 does not achieve a separation of the edge covering 3 from the closure part 14 over the circumference in the area relevant for the invention.

Moreover, the conventional diaphragm according to FIG. 9 suffers from the fact that the adherence of the two diaphragm layers in the edge covering area (3*a*, 3*i*) would have to be lower than in the vertical (21*a*, 21*i*) and horizontal (14*a*, 14*i*) closure area.

Conversely, the open end 16 of the finished-closed can 17 according to the present invention as per FIG. 10 (FIG. 10*a*, FIG. 10*b*) is enclasped by the now separated, annular flange 3 of the diaphragm 14. The upper end 19, 19′ of the cylindrical wall 21 is arranged at a short distance a from the lower end 23, 23′ of the inside leg of the flange 3, the distance being just large enough for the earlier severance points 4 (FIG. 1) to be torn. Namely, subjected to pull, clean tearing will usually occur as opposed to the conventional peeling when the can is opened, in which case the inside leg of the flange 3 can frequently be frayed as is mentioned above. For this reason a diaphragm other than the one according to the present invention, insofar as it has only a severance point extending over the circumference of its cylindrical wall part, can also eventually be used for the manufacurre of the can according to the present invention, even though because of its easy manufacturability the diaphragm according to the present invention is preferred.

During the closing and tear-off operation the heat-sealing layer 24 adheres to the inside lining 18 of the can, of which an uninjured circumferential strip 22 is retained after the ligaments 4 (FIG. 1) are torn through.

I claim:

1. A container having a cylindrical wall having an interior surface with said wall surrounding an opening at one end of said container and said opening being closed by a diaphragm, said diaphragm having a substantially planar wall portion and a peripheral wall surrounding said planar wall portion and extending upwardly relative thereof to define a dish shape, said peripheral wall terminating in a rim, said diaphragm having a substantially uniform thickness of no greater than approximately 60 microns, said peripheral wall being formed with a plurality of elongated slits arranged along a circumferential line lying in a plane parallel to spaced a selected distance from said planar wall portion, each of said slits being separated from each adjacent slit by a ligament lying on said circumferential line, said peripheral wall being adhesively secured to said interior surface of said wall of said container and with said ligaments being separated.

2. The diaphragm as claimed in claim 1 wherein said slits extend along 70 to 99 percent of the length of said circumferential line.

3. The container as claimed in claim 17 wherein said slits extend along 70 to 99 percent of said circumferential line.

4. The diaphragm as claimed in claim 1 wherein said selected distance is more than 50 percent of the vertical height of said peripheral wall.

5. The container as claimed in claim 17 wherein said selected distance is more than 50 percent of the vertical height of said peripheral wall.

6. The diaphragm as claimed in claim 1 wherein said ligaments are bent at least over a portion of their widths.

7. The container as claimed in claim 17 wherein said ligaments are reduced in thickness at least over a portion of their widths.

* * * * *